US007040957B2

(12) United States Patent
Schultz et al.

(10) Patent No.: US 7,040,957 B2
(45) Date of Patent: May 9, 2006

(54) PLATEN AND MANIFOLD FOR POLISHING WORKPIECES

(75) Inventors: Stephen C. Schultz, Gilbert, AZ (US); John D. Herb, Phoenix, AZ (US); Dave Marquardt, Phoenix, AZ (US)

(73) Assignee: Novellus Systems Inc., San Jose, CA (US)

( * ) Notice: Subject to any disclaimer, the term of this patent is extended or adjusted under 35 U.S.C. 154(b) by 0 days.

(21) Appl. No.: 10/642,313

(22) Filed: Aug. 14, 2003

(65) Prior Publication Data

US 2004/0033759 A1 Feb. 19, 2004

Related U.S. Application Data

(60) Provisional application No. 60/403,355, filed on Aug. 14, 2002.

(51) Int. Cl.
*B24B 49/00* (2006.01)
*B24B 51/00* (2006.01)

(52) U.S. Cl. ..... 451/6; 451/5

(58) Field of Classification Search ..... 451/6, 451/5

See application file for complete search history.

(56) References Cited

U.S. PATENT DOCUMENTS 5,433,651 A 7/1995 Lustig et al.
5,527,424 A * 6/1996 Mullins ..... 438/692
5,584,750 A * 12/1996 Ishida et al. ..... 451/288
5,605,760 A 2/1997 Roberts
5,609,511 A 3/1997 Moriyama et al.
5,738,574 A * 4/1998 Tolles et al. ..... 451/288
5,743,788 A * 4/1998 Vanell ..... 451/41
5,762,536 A * 6/1998 Pant et al. ..... 451/6
5,838,447 A 11/1998 Hiyama et al.
5,893,796 A * 4/1999 Birang et al. ..... 451/526
5,943,302 A 8/1999 Fanshaw
5,949,927 A 9/1999 Tang
6,012,967 A * 1/2000 Satake et al. ..... 451/36
6,045,439 A 4/2000 Birang et al.
6,068,539 A 5/2000 Bajaj et al.
6,106,662 A 8/2000 Bibby, Jr. et al.
6,146,242 A * 11/2000 Treur et al. ..... 451/6

(Continued)

FOREIGN PATENT DOCUMENTS

EP 0 824 995 A1 2/1998

(Continued)

*Primary Examiner*—Joseph J. Hail, III
*Assistant Examiner*—Bryan R. Muller
(74) *Attorney, Agent, or Firm*—Ingrassia Fisher & Lorenz PC

(57) ABSTRACT

In a chemical mechanical wafer processing apparatus, a platen for supporting a polishing pad, a manifold for delivering a chemical to the platen, a workpiece substantially in contact with a polishing pad supported by the platen, a light transmission medium for transmitting and receiving light to and from the workpiece, one end of the medium being substantially flush with the top of the polishing pad, the other end of the transmission medium having a hollow portion for receiving a light transmitting and receiving probe, thereby providing a light transmitting and receiving probe in close proximity to the workpiece. The platen and manifold of the apparatus are substantially of non-metallic material and may be joined by spaced clamps and latches.

9 Claims, 6 Drawing Sheets

U.S. PATENT DOCUMENTS 6,203,417 B1 3/2001 Dyer et al.
6,254,453 B1 * 7/2001 Li et al. ..... 451/8
6,280,297 B1 8/2001 Tolles et al.
6,454,630 B1 9/2002 Tolles
6,485,354 B1 11/2002 Wolf
6,488,568 B1 12/2002 Treur et al.
6,544,104 B1 * 4/2003 Koike et al. ..... 451/9
6,599,765 B1 * 7/2003 Boyd et al. ..... 438/16
6,641,470 B1 * 11/2003 Zhao et al. ..... 451/523

FOREIGN PATENT DOCUMENTS

WO WO 01/15861 A1 * 8/2001

* cited by examiner

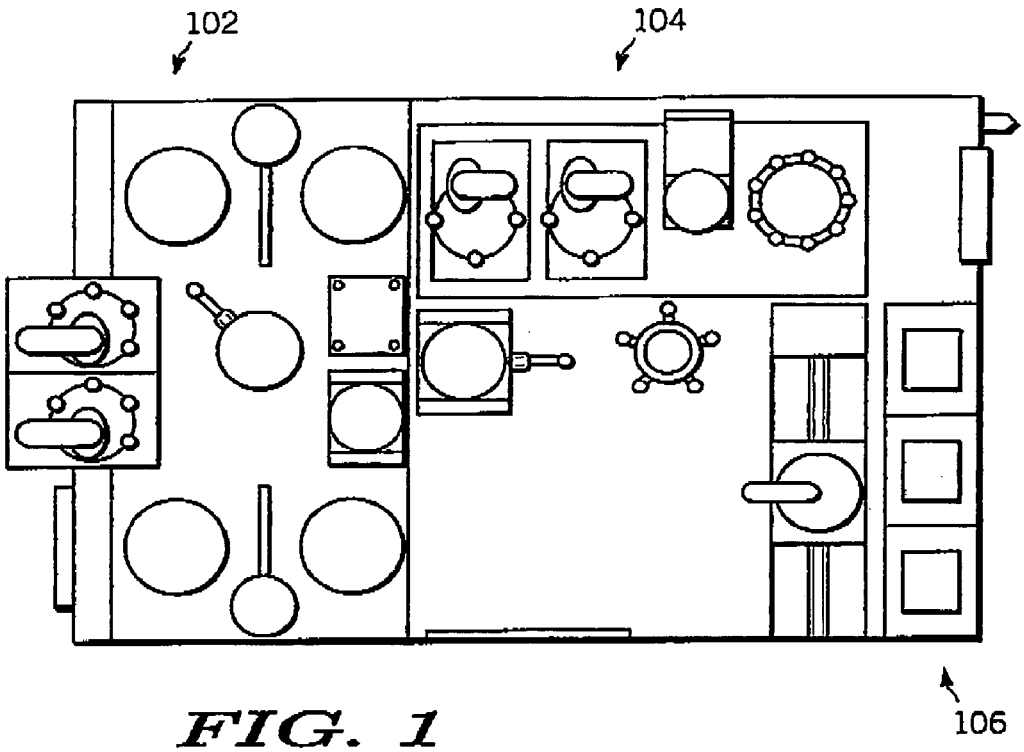
FIG. 1
-PRIOR ART-
FIG. 2
-PRIOR ART-
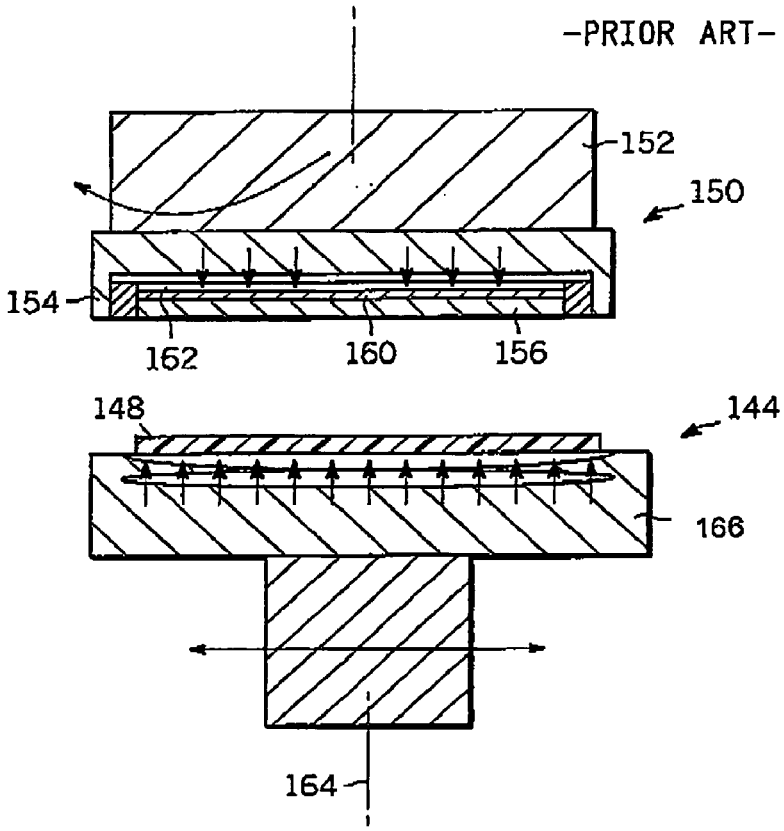

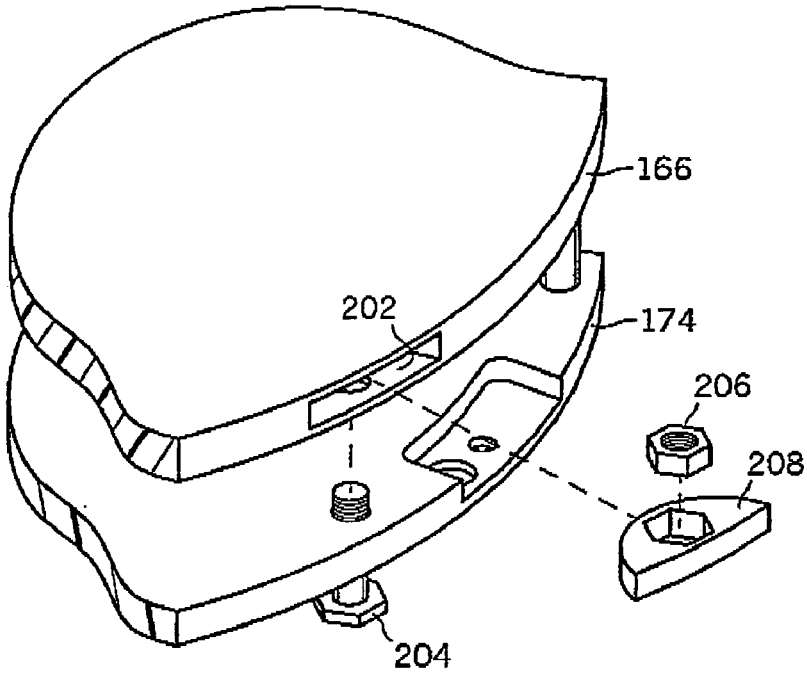
FIG. 7
FIG. 8
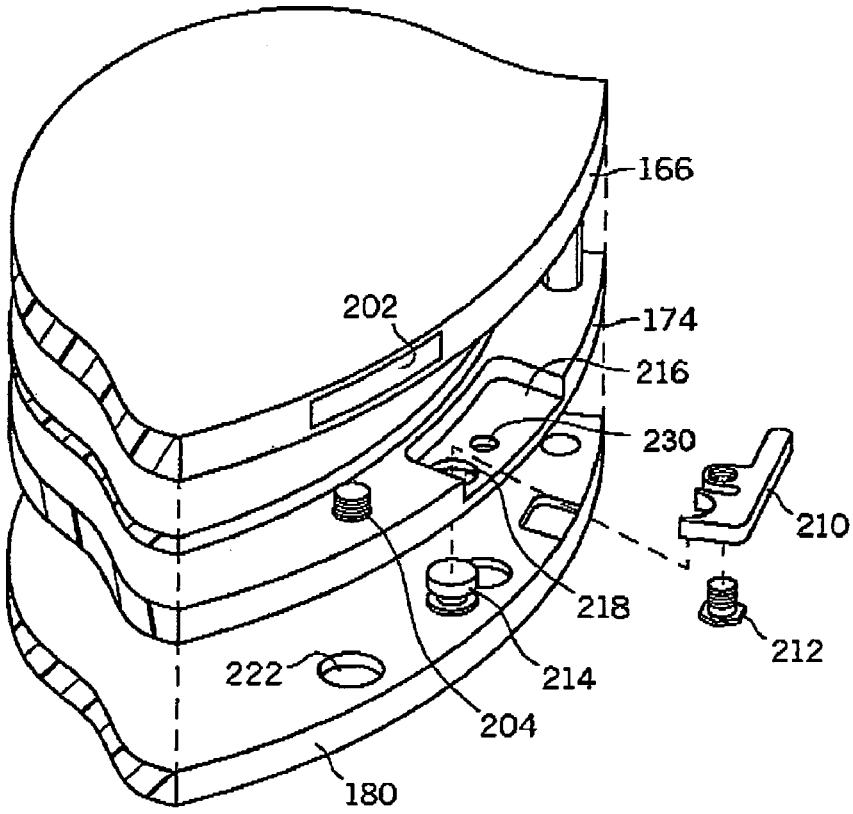

PLATEN AND MANIFOLD FOR POLISHING WORKPIECES

CROSS-REFERENCES TO RELATED APPLICATIONS

This application claims the benefit of U.S. Provisional Application No. 60/403,355, filed Aug. 14, 2002.

TECHNICAL FIELD

The present invention relates generally to an apparatus and method for polishing a surface of a workpiece. More particularly, the invention relates to improved methods and apparatus for utilizing chemical-mechanical planarization in the manufacture of semiconductors.

BACKGROUND

Chemical-mechanical polishing or planarization of the surface of an object may be desirable for several reasons. For example, a flat disk or wafer of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (composite thin film layers usually made of metals for conductors or oxides for insulators) applied to the wafer must also be made of a uniform thickness.

Planarization is the process of removing projections and other imperfections to create a flat planar surface and/or a uniform thickness for a deposited thin film layer on a wafer. Semiconductor wafers are planarized or polished to achieve a smooth, flat finish before performing lithographic processing steps that create integrated circuitry or interconnects on the wafer. A considerable amount of effort in the manufacturing of modern complex, high-density multilevel interconnects is devoted to the planarization of the individual layers of the interconnect structure. Non-planar surfaces result in poor optical resolution of subsequent photolithographic processing steps which in turn prohibits the printing of high-density features. If a metallization step height is too large, there is a serious danger that open circuits will be created. Since planar interconnect surface layers are required for the fabrication of modern high density integrated circuits, chemical-mechanical polishing (CMP) tools have been developed to provide controlled planarization of both structured and unstructured wafers.

In a conventional CMP tool for planarizing a wafer, the wafer is secured in a carrier connected to a shaft. The shaft is typically connected to mechanical means for transporting the wafer between a load or unload station and a position adjacent to a polishing pad mounted to a rigid or a flexible platen. Pressure is exerted on the back surface of the wafer by the carrier in order to press the wafer against the polishing pad usually in the presence of a slurry. The wafer and/or polishing pad are then moved in relation to each other by means of, for example, motors connected to the shaft and/or platen, in order to remove material in a planar manner from the front surface of the wafer.

Existing solid platens and associated slurry delivery systems (manifolds) are typically made from stainless steel (for example, 300 series stainless steel) and titanium. In the CMP process these metals are exposed to chemical environments where the pH range is from 1.0 to 14.0. Under these conditions metallic corrosion will occur. Treatments such as passivation and electropolish reduce the corrosion rate but, inevitably, all metals will corrode.

The effects of corrosion on the CMP process are unacceptable. Corrosion adds destructive particles to the slurry and could potentially damage devices on a wafer being polished. Another effect of metallic corrosion is increased defectivity beyond acceptable limits, particularly in today's environment of increasing smaller tolerances and feature size of semiconductor wafer patterning.

Consequently it would be desirable to provide a platen and slurry delivery system that eliminates metallic corrosion in the platen and manifold of a CMP system.

In addition to metallic corrosion, adhesive wear, also known as Galling, contributes to particle generation within the slurry delivery system. Galling initiates at the platen/manifold interface, and is induced by pressure and slight relative movement. As with corrosion, particle generation from Galling contributes to an increase in defectivity.

It would, therefore, be desirable to provide an improved platen/manifold interface to reduce or eliminate Galling.

It is often desirable to monitor the front surface of a wafer during the planarization process. One known method involves the use of an optical system that interrogates the front surface of the wafer in situ by positioning an optical probe under the polishing surface and transmitting and receiving an optical signal through an opening in the polishing pad. In some systems, the opening in the polishing pad is filled with an optically transparent material, or "window", in order to prevent polishing slurry or other contaminants from being deposited into the probe and obscuring the optical path to the wafer. It is possible to adjust the planarization process based upon these real-time measurements or to terminate the process when the front surface of the wafer has reached the desired condition.

In view of the foregoing, it should be appreciated that it would be desirable to provide an improved polishing pad/platen window or lens for use in a chemical-mechanical polishing apparatus that exhibits good optical properties through which in situ monitoring of the wafer may be accomplished during the chemical-mechanical polishing process. It would further be desirable that the polishing pad/platen window or lens be easy to manufacture, easily to deploy in the polishing pad/platen, and easy to remove and replace.

Furthermore, other desirable features and characteristics of the present invention will become apparent from the subsequent detailed description and the appended claims, taken in conjunction with the accompanying drawings and the foregoing technical field and background.

SUMMARY

In a chemical mechanical wafer processing apparatus, a platen for supporting a polishing pad, a manifold for delivering a chemical to the platen, a workpiece substantially in contact with a polishing pad supported by the platen, a light transmission medium for transmitting and receiving light to and from the workpiece, one end of the medium being substantially flush with the top of the polishing pad, the other end of the transmission medium having a hollow portion for receiving a light transmitting and receiving probe, thereby providing a light transmitting and receiving probe in close proximity to the workpiece. The platen and manifold of the apparatus are substantially of non-metallic material and may be joined by spaced clamps and latches.

BRIEF DESCRIPTION OF THE DRAWINGS

The present invention will hereinafter be described in conjunction with the following drawing figures, wherein like numerals denote like elements, and FIG. 1 illustrates a top cutaway view of a prior art polishing apparatus suitable for removing material from a surface of a workpiece in accordance with the present invention;

FIG. 2 illustrates a cross-sectional view of a polishing apparatus in accordance with one embodiment of the present invention;

FIG. 7 illustrates a method and apparatus for clamping a manifold and platen;

FIG. 8 illustrates a platen retaining latch that latches the platen-manifold combination to the polishing bell;

DETAILED DESCRIPTION

Figure 3:
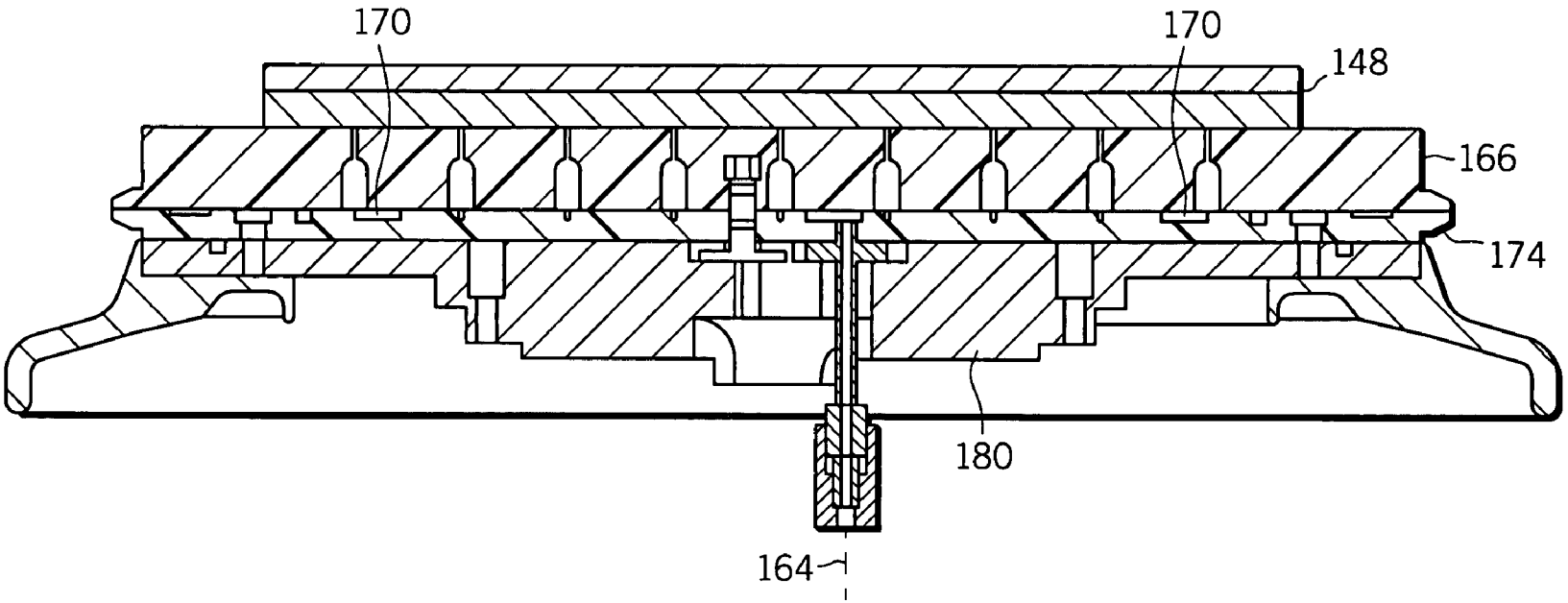
FIG. 3 is a cross-sectional view of a lower portion of the lower polishing module as shown schematically in FIG. 2.

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

FIG. 1 illustrates a top cutaway view of a polishing apparatus suitable for removing material from a surface of a workpiece in accordance with the present invention. The apparatus may include a multi-platen polishing system 102, a cleaning system 104, and a wafer load and unload station 106, or may be a single platen polishing system in which the polishing, cleaning and wafer load and unload systems are separated. In addition, the apparatus includes a cover (not illustrated) that surrounds the apparatus to isolate it from the surrounding environment. An example of such an apparatus is a Momentum machine available from SpeedFam-IPEC Corporation of Chandler, Ariz.; however, it may be any machine capable of removing material from a workpiece surface. Such a machine is also described in U.S. Pat. No. 6,586,337, dated Jul. 1, 2003, and assigned to the assignee of the present invention. U.S. Pat. No. 6,586,337 is incorporated herein by reference.

Although the present invention may be used to remove material from a surface of a variety of workpieces such as magnetic disks, optical disks, and the like, the invention is conveniently described below in connection with removing material from a surface of a semiconductor wafer. In the context of the present invention, the term "wafer" shall mean semiconductor substrates, that may or may not include layers of insulating, semiconducting, and conducting layers or features formed thereon and used in the manufacture of microelectronic devices.

FIG. 2 is a schematic cross-sectional view of a polishing apparatus suitable for use in the apparatus shown in FIG. 1 for polishing a surface of a wafer in accordance with the present invention. The apparatus includes a lower polishing module 144 that in turn includes a platen 166 and a polishing surface or pad 148. An upper polishing module 150 includes a body 152 and a retaining ring 154 which retains wafer 156 during polishing.

Upper polishing module or carrier 150 is generally configured to receive a wafer for polishing and urge the wafer against the polishing surface during the polishing process. Carrier 150 applies a vacuum force to the back side of wafer 156, retains the wafer, moves in the direction of the polishing surface to place the wafer in contact with polishing surface 148, releases the vacuum, and applies a force (e.g., about 3 PSI) in the direction of the polishing surface. In addition, carrier 150 is configured to cause the wafer to move. For example, carrier 150 may be configured to cause the wafer to move in a rotational, orbital, or translational direction. Carrier 150 may be configured to rotate at a rate between two RPM and twenty RPM about an axis 158.

Carrier 150 also includes a resilient film 160 interposed between wafer 156 and body 152 to provide a cushion during the polishing process and may also include an air bladder 162 configured to provide a desired, controllable pressure to a backside of the wafer during the polishing process. In this case, the bladder may be divided into zones such that various amounts of pressure may be independently applied to each zone.

Lower polishing module 144 is generally configured to cause the polishing surface to move. By way of example, lower module 144 may cause the polishing surface to rotate, translate, orbit, or any combination thereof. For example, lower module 144 may be configured such that platen 166 orbits at a radius of approximately one-eighth inch to one inch about an axis 164 at, for example, 30 to 2000 orbits per minute while simultaneously causing platen 166 to dither or partially rotate. In This case, material is removed primarily from the orbital motion of platen 166. This allows a relatively constant speed between the wafer surface and the polishing surface to be maintained during a polishing process, and thus material removal rates are maintained relatively constant across the wafer surface.

Polishing machines including orbiting lower modules 144 are additionally advantageous because they require relatively little space when compared to rotational polishing modules. In particular, because a relatively constant velocity between the wafer surface and the polishing surface can be maintained across the wafer surface by moving the polishing surface in an orbital motion, the polishing surface can be about the same size as the surface to be polished. For example, a diameter of a polishing surface may be only 0.5 inches greater than the diameter of the wafer.

FIG. 3 is a cross-sectional view of a lower portion of the lower polishing module as shown schematically in FIG. 2. It includes the platen 166 and a polishing surface 148 suitable for use in conjunction with the polishing apparatus shown in FIG. 2. It should be noted that, although reference is made to polishing, the invention herein is equally applicable to buffing. For ease of description, however, we will continue to primarily reference polishing. Platen 166 and polishing surface or pad 148 include channels or conduits 170 formed therein to allow polishing fluid such as slurry to flow through platen 166 and surface 148 towards a surface of the wafer during the polishing process. Flowing slurry toward the surface of the wafer during the polishing process is advantageous because the slurry acts as a lubricant and thus reduces friction between the wafer surface and the polishing surface 148. In addition, providing slurry through the platen and toward the wafer facilitates uniform distribution of the slurry across the surface of the wafer which in turn facilitates uniform material removal from the wafer surface. Slurry flow rates may be selected for a particular application, however, the slurry flow rates are generally less than 200 ml/minute and preferably about 120 ml/minute.

As illustrated in FIG. 3, the polishing pad 148 may consist of a single pad or may have multiple layers, usually bonded together to achieve a particular surface quality. Under the platen 166 is a slurry delivery system or manifold 174 that may be a single layer or have multiple layers depending upon the requirements for slurry distribution, volume, and the number of paths for slurry delivery that are required. A polish bell 180 supports the manifold 174, platen 166 and polishing pad 148. The polish bell 180 is driven in a preferred motion about an axis 164 as previously described. The bell may be manufactured of any suitable material having the requisite stiffness to support the manifold 174, platen 166 and pad 148 in an extremely flat condition such that the polishing of the wafer removes material equally across the expanse of the wafer.

As previously noted, existing solid platens and associated slurry delivery systems (manifolds) are typically made from stainless steel (for example, 300 series stainless steel) and titanium. In the CMP process these metals are exposed to chemical environments where the pH range is from 1.0 to 14.0. Under these conditions metallic corrosion will occur. Treatments such as passivation and electropolish reduce the corrosion rate but, inevitably, all metals will corrode.

The effects of corrosion on the CMP process are unacceptable. Corrosion adds destructive particles to the slurry and could potentially damage devices on a wafer being polished. Another effect of metallic corrosion is increased defectivity beyond acceptable limits, particularly in today's environment of increasing smaller tolerances and feature size of semiconductor wafer patterning.

In addition, adhesive wear, or Galling, contributes to particle generation within the slurry delivery system. Galling initiates at the platen/manifold interface, and is induced by pressure and slight relative movement. As with corrosion, particle generation from Galling contributes to an increase in defectivity.

In order to reduce or eliminate the problems relating to metal corrosion and Galling, the platen and manifold of the present invention are constructed of non-metallic material such as plastic or ceramic materials, or of metallic materials coated with plastic or ceramic materials such that the metals do not contact the slurry and contribute to particle generation to contaminate the slurry. In addition, plastics and a number of ceramics have superior pH handling characteristics.

In a preferred embodiment a plastic such as PPS-techron may be used as it has low water absorption, good compressive strength, a wide pH range and a relatively low expansion coefficient. And although ceramics and coated materials offer some advantages over the metallic solutions now in use, plastic offers the additional advantages of lower relative cost, excellent chemical resistance, light weight for easy handling and lower bearing wear in use, and they are easy to machine.

Figure 4:
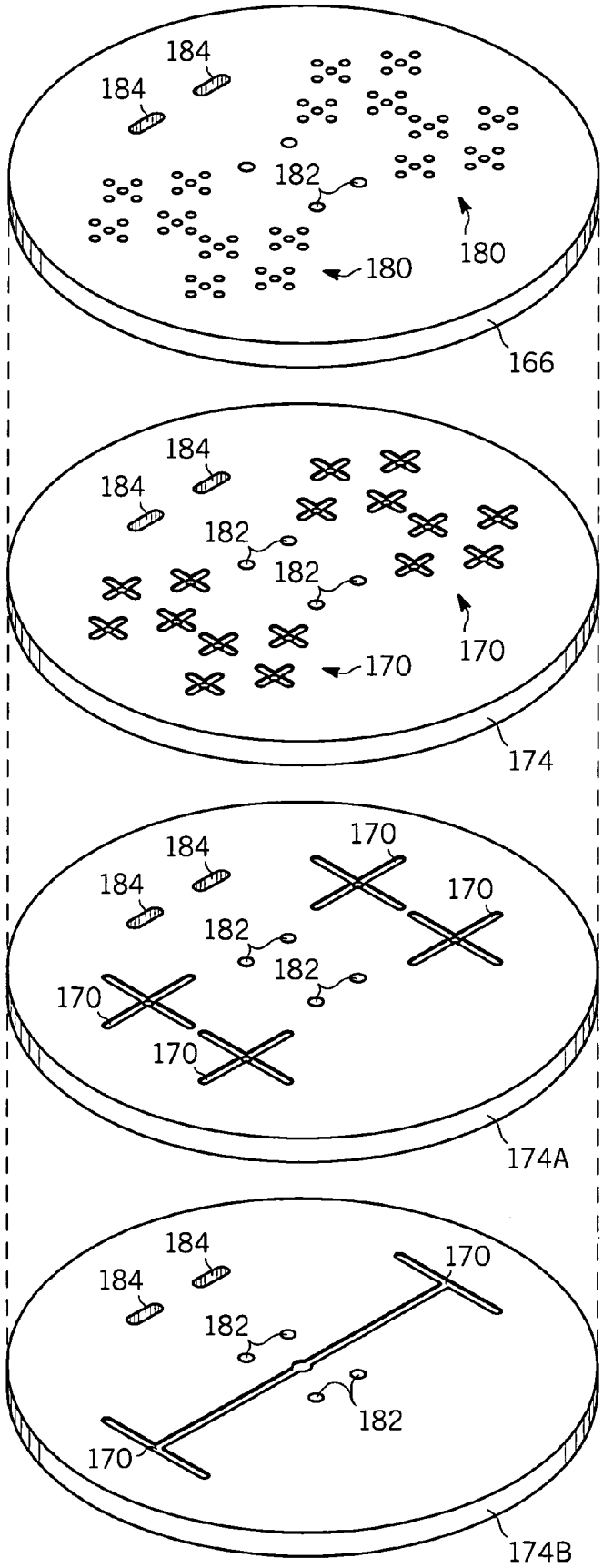
FIG. 4 shows a platen and a manifold in exploded view.

The easy machineability allows both platens and manifolds to be inexpensively fabricated and allows easier production of, for example, multi-layer manifolds. FIG. 4 shows a platen 166 and a manifold 174 in exploded view, it being understood that in use the platen and manifold are tightly coupled. Platen 166 has a plurality of holes 180 through which slurry from manifold 174 is carried. The polishing pad (not shown in this illustration) likewise has corresponding holes or sufficient porosity to allow the slurry to reach the workpiece or wafer 156 which may be mounted on the upper module 154 as shown in FIG. 2. The manifold 174 has a series of grooves or conduits 170 to carry slurry from the slurry supply mechanism (not shown) to the platen 166. The conduits 170 communicate with holes 180 in the platen 166. A second manifold 174A is also shown, manifold 174A having its own pattern of conduits 170 that communicate with conduits 170 in manifold 174. Likewise, a third manifold 174B is shown with its own conduits 170 that communicate with conduits 170 of manifold 174A.

It can be seen that, as an example of the utility of multiple manifolds, beginning with four outlets in conduits 170 of manifold 174B, the pattern in manifold 174A increases the number of outlets to sixteen in manifold 174A, and then to sixty-four in manifold 174. This allows a pattern of 256 holes 180 in the platen 166 to be used to apply chemicals or slurry to the pad (not shown in this FIG. The easy machinability of the plastic material eases the manufacture of systems with multiple manifolds which allow for a greater number of fluid paths, the use of multiple chemicals simultaneously or serially, and separate inputs and outputs for different chemicals. If a plastic material is used, manifolds may be molded and then fuse bonded together to form a unitary manifold with multiple manifold characteristics thus avoiding problems usually associated with coupling various components of a system rigidly together.

The platen 166 and the manifolds 174, 174A, and 174B have another set of holes 182 through which a light pin or an end point probe is applied (depending upon whether reference is to the holes in the platen or the manifold) to sense the progress of the polishing and when the polishing process is complete. While four holes 182 are shown in each element here, the number of holes can be any number suitable for a particular process. End point detection will be addressed later. There is yet another set of holes 184 both in the platen 166 and the manifolds 174, 174A, and 174B. The function of these holes 184 will also be discussed later in conjunction with another figure. It is apparent that it is advantageous to easily machine both the platen and the manifold to provide the holes and conduits for the application of slurry and for the endpoint detection mechanism.

Figure 5:
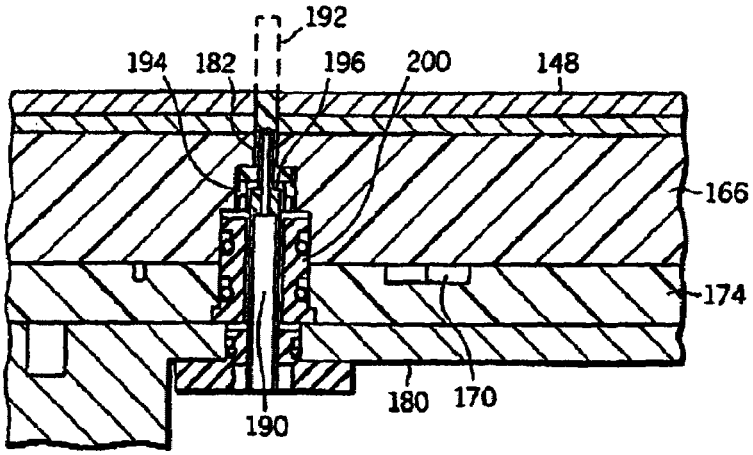
FIG. 5 shows in some detail a side view of a portion of the lower polish head assembly.

FIG. 5 shows in some detail a side view of a portion of the lower polish head assembly 144. The polish pad 148 is atop the platen 166 that, in turn, is atop the slurry manifold 174 and the polish bell 180. Conduits 170 in the manifold 174 are also shown. An end point probe 190 is shown extending through the polish bell 180, the manifold 174, and into the platen 166. A light pin 192 is shown affixed to the platen 166 by a retaining screw 194, although the pin could alternatively be press fit into the platen. The light pin 192 is of a plastic, epoxy, or urethane material and extends through the platen, through holes 182 as shown in FIG. 4 and also through the polishing pad 148 when the pad is in place. Because the light pin initially extends through the polishing pad 148, the pin can be used as a registration guide for providing proper position of the pad 148 on the platen 166. As explained more fully below, the top portion of light pin 192 is subsequently trimmed off flush with the top surface of polishing pad 148. Accordingly the top portion of light pin 192, the portion that is subsequently removed, is shown in phantom in FIG. 5.

An end point probe 190 is inserted through a hole in the manifold that is in registration with hole 182 in the platen. The end point probe 190 has a larger diameter at the bottom for strength, but has a smaller diameter at its top portion. The light pin 192 is hollow at its bottom portion and the smaller diameter portion of the end point probe 190 is inserted into the hollow portion of the light pin. The end point probe itself is mounted on the polishing bell.

Figure 6:
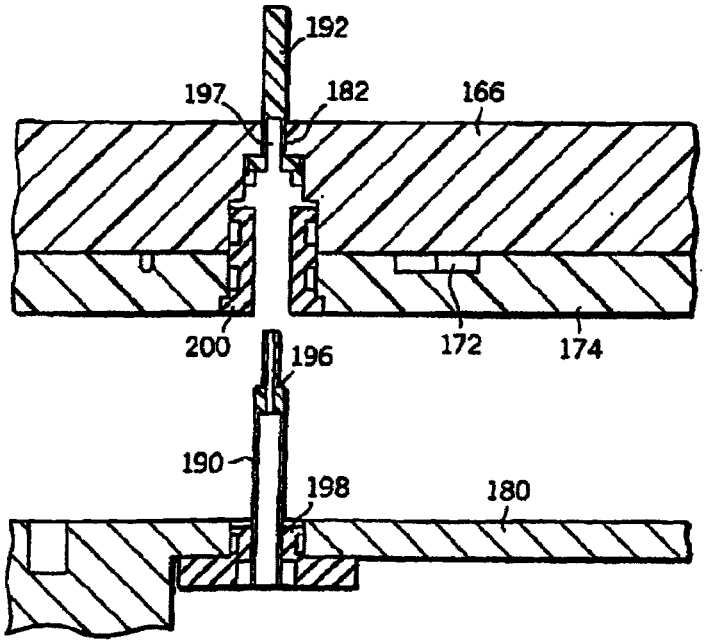
FIG. 6 shows an exploded illustration of a light pin and end point probe.

FIG. 6 shows an exploded illustration of the light pin 192 and end point probe 190 that more clearly shows the relationship among the polish bell 180, manifold 174, platen 166, the pin 192 and the probe 190. The shoulder 196 of The end point probe 190 is clearly shown, as is the hollow portion 197 of the light pin 192. The hollow portion 197 of the light pin 192 allows the narrowed top of the end point probe 190 to be seated flush with the top of the platen as can be seen in FIG. 5. The flush mounting of The end of The end point probe provides an improvement in the ability of The end point detector (not shown) to detect the completion of the polishing process as earlier discussed. An O-ring seal 198 is shown that prevents fluid from getting past the top of the polishing bell 180. Another seal 200, seals the end point probe from the manifold 174 and platen 166.

The portion of the light pin 192 extending through the polishing pad 148 is removed flush with the top of the polishing pad 148 prior to use, by severing the top of the pin 192 and utilizing a pad conditioner (which typically is a steel platform with an abrasive diamond surface that is used to condition or level the pad prior to wafer processing) to level the light pin to be flush with the pad.

The foregoing arrangement of light pin and probe offers several advantages. Since the end point probe 190 is accessible from the bottom of the polishing bell, it is not necessary to disassemble the bell, manifold and platen to replace the probe. Additionally, the light pin can be accessed for replacement in two ways; the manifold can be removed from the platen and the light pin 192 released from the platen by removing the retaining screw 194, or The manifold can remain in place and the probe seal is removed from the manifold. The end point probe 190, being mounted on the bell, remains in place. This arrangement is advantageous in requiring little or no disassembly to change pins or probes.

Typically the platen is held to the manifold by means of a v-band clamp that attaches over a rim of the platen and under a ridge of the manifold. This arrangement has become somewhat unsatisfactory as requirements for elimination of particles has become more critical. This is due to the propensity of v-band fasteners to allow very small relative movement between the platen and manifold thus causing Galling as previously discussed.

FIG. 7 illustrates a method and apparatus for clamping a manifold 174 and a platen 166 such that the micro relative motion between the manifold and platen is removed. Motion between the manifold 174 and the platen 166 would generate undesirable production of particles in the slurry delivery system due to Galling. The platen 166 is clamped to the manifold 174 by plastic (such as PEEK) or metal bolts and nuts. A slot 202 is machined into the edge of platen 166 and a bolt is inserted through a hole in the manifold and a hole in the platen at the location of slot 202. A bolt 204 is inserted from the bottom of the manifold 174 to the hole in the platen 166. A preferably plastic or Erdalite nut retainer biscuit 208 containing the nut 206 is placed in the slot 202 over the hole in the platen 166. The center of nut 206 is offset from the center of biscuit 208 such that the biscuit will be held in place while bolt 204 is torqued to a specified value. When it is desired to disassemble the platen from the manifold, once the bolt is removed the biscuit 208 can be removed by pushing on one end of the off center biscuit which rotates the biscuit out of the slot 202. A number of these clamping positions are provided around the perimeters of the platen and manifold to assure adequate clamping pressure.

Figure 9:
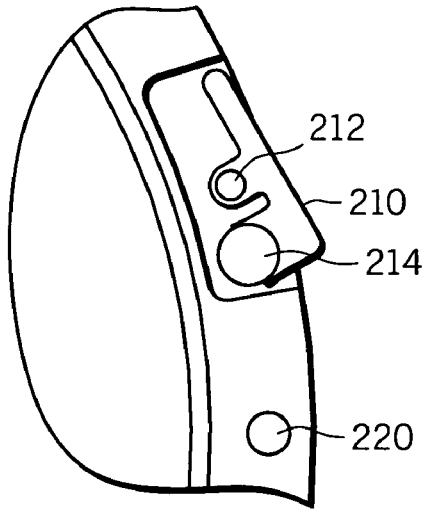
FIG. 9 illustrates the latch of FIG. 8 in a latched position.

FIG. 8 illustrates a platen retaining latch that latches the platen-manifold combination to the polishing bell 180. A latch 210 is bolted by a bolt 212 that is inserted through a hole 230 in a recess 216 machined into the periphery of the manifold 174. Bolt 212 is subsequently secured into the platen 166. A torque pin 214 is mounted on The polishing bell 180 such that when the manifold is brought into contact with bell 180 the torque pin protrudes through a hole 218 in the recess 216. In FIG. 9 it can be seen that The latch 210 captures the platen/manifold assembly in the vertical axis. The torque pins capture the bell 180 in The XY plane as they cooperate with corresponding holes in the periphery of the manifold. The use of the clamping and manifold assembly techniques eliminates The need for the v-band clamps and provide a method for quickly disassembling the platen away from the bell assembly.

Figure 10:
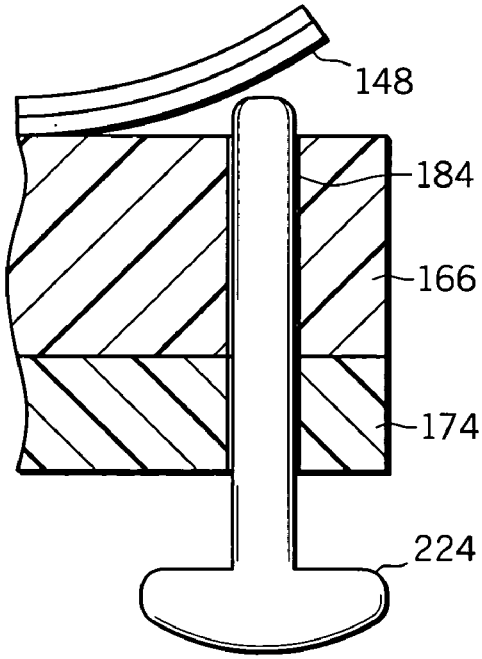
FIG. 10 illustrates a method for releasing a pad from a platen.

In prior art polishing systems, it was relatively difficult to remove the polishing pad 148 from the platen, the operator frequently having to resort to scraping the edge of the pad with a knife to loosen the pad from the platen. In FIG. 4 there was described a platen/manifold combination having a series of holes therethrough. One or more of the holes 184 are provided for the purpose of allowing a Last and easy mechanism for removing pads from platens. As can be seen in FIG. 10 holes 184 have been provided through the platen 166 and the manifold 174 near the periphery of the polishing pad 148. A key or punch 224 may be inserted through one of the holes 184 in order to lift an edge of the pad 148 from the platen 166 thereby easing the task of securing the pad for removal. The ability to easily work the plastic platen and manifold material or alternatively ceramic or coated materials allows additional holes to be drilled and recesses to be machined more easily than do prior platen and manifold materials.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An assembly for use in a chemical-mechanical apparatus, comprising:

a pad having an upper surface and having at least a first aperture therethrough;

a platen for supporting said pad, said platen having a top surface and at least a second aperture therethrough; and a substantially transparent plug including at least a first section and at least a second section, the first section positioned substantially within the first aperture and having an end substantially flush with the upper surface of the pad, and the second section positioned substantially within the second aperture, the second section being partially hollow;

a light transmitting and receiving probe having a first portion and a second portion, the first portion having a diameter larger than the second portion, and the second portion being adapted to fit within the hollow section of the substantially transparent plug, the second portion having a top positioned flush with the top surface of the platen.

2. An assembly as set forth in claim 1 wherein the platen is constructed of a non-metallic material.

3. An assembly as set forth in claim 1 wherein the platen has a plurality of holes for delivering a slurry to the pad.

4. An assembly as set forth in claim 3 further comprising a manifold coupled to the platen for providing a slurry to the platen.

5. An assembly as set forth in claim 3 wherein the exterior of the platen is constructed of a non-metallic material.

6. An assembly as set forth in claim 4 wherein the exterior of the platen is constructed entirely of a non-metallic material.

7. An assembly as set forth in claim 4 wherein the exteriors of the platen and the manifold are constructed entirely of a non-metallic material.

8. A chemical mechanical wafer processing apparatus comprising;

a polishing pad having a top surface;

a platen having a ton surface for supporting the polishing pad, a manifold for delivering a slurry to the platen, an upper polishing module configured to position a workpiece substantially in contact with the polishing pad supported by the platen, a light transmission medium for transmitting and receiving light to and from the workpiece, one end of the medium positioned flush with the top surface of the polishing pad prior to initiation of a polishing operation, the other end of the transmission medium having a hollow portion for receiving a light transmitting and receiving probe, the light transmitting and receiving probe having an end portion flush with the top of the platen.

9. An apparatus as set forth in claim 8 wherein the light transmission medium is used as a registration guide for positioning the pad on the platen.

* * * * *

UNITED STATES PATENT AND TRADEMARK OFFICE

CERTIFICATE OF CORRECTION

PATENT NO. : 7,040,957 B2
APPLICATION NO. : 10/642313
DATED : May 9, 2006
INVENTOR(S) : Stephen C. Schultz et al.

It is certified that error appears in the above-identified patent and that said Letters Patent is hereby corrected as shown below:

In Column 10, line 4, delete "ton" and add --top--.

Signed and Sealed this

Sixth Day of March, 2007

JON W. DUDAS
*Director of the United States Patent and Trademark Office*